US007727013B1

(12) United States Patent
Paynter

(10) Patent No.: US 7,727,013 B1
(45) Date of Patent: Jun. 1, 2010

(54) LOW PIM ROTATABLE CONNECTOR

(75) Inventor: Jeffrey Paynter, Momence, IL (US)

(73) Assignee: Andrew LLC, Hickory, NC (US)

( * ) Notice: Subject to any disclaimer, the term of this patent is extended or adjusted under 35 U.S.C. 154(b) by 0 days.

(21) Appl. No.: 12/361,720

(22) Filed: Jan. 29, 2009

(51) Int. Cl.
*H01R 9/05* (2006.01)

(52) U.S. Cl. ..... 439/578

(58) Field of Classification Search ..... 439/578, 439/582–585

See application file for complete search history.

(56) References Cited

U.S. PATENT DOCUMENTS 3,739,076 A * 6/1973 Schwartz ..... 174/78
4,213,664 A * 7/1980 McClenan ..... 439/95
5,795,188 A 8/1998 Harwath
6,133,532 A 10/2000 Lundback et al.
6,793,529 B1 9/2004 Buenz
7,335,059 B2 2/2008 Vaccaro et al.

* cited by examiner

*Primary Examiner*—Ross N Gushi
(74) *Attorney, Agent, or Firm*—Babcock IP, PLLC

(57) ABSTRACT

A coupling arrangement between a coaxial connector body and an outer conductor of a coaxial cable that includes an annular contact groove provided in a bore of the connector body. The contact groove has a groove bottom, a connector end sidewall and a cable end sidewall. The connector end sidewall is angled to transition between a groove bottom width that is less than a groove top width. A spring contact has a non-deformed state width seated within the contact groove. The non-deformed state width is greater than the groove bottom width and less than the groove top width. In a non-deformed state the spring contact contacts the connector end sidewall, without contacting the groove bottom.

20 Claims, 6 Drawing Sheets

-Related Art-

-Related Art-

-Related Art-

LOW PIM ROTATABLE CONNECTOR

BACKGROUND

1. Field of the Invention

This invention relates to electrical cable connectors. More particularly, the invention relates to a solid outer conductor coaxial cable connector that is rotatable while mounted upon the cable end, which exhibits an improved passive intermodulation distortion (PIM) electrical performance.

2. Description of Related Art

Coaxial cable connectors are used, for example, in communication systems requiring high levels of electrical performance, precision and reliability.

To create a secure mechanical and optimized electrical interconnection between the cable and the connector, it is desirable to have generally uniform, circumferential contact between a leading edge of the coaxial cable outer conductor and the connector body. A flared end of the outer conductor may be clamped against an annular wedge surface of the connector body, via a coupling nut. Representative of this technology is commonly owned U.S. Pat. No. 7,335,059 issued Feb. 26, 2008 to Vaccaro.

During systems installation, rotational forces may be applied to the installed connector, for example as the attached coaxial cable is routed towards the next interconnection, maneuvered into position and/or curved for alignment with cable supports and/or retaining hangers. Rotation of the coaxial cable and a cable end clamping type coaxial connector with respect to each other may damage the connector, cable and/or the integrity of the cable/connector clamp interconnection.

Competition in the coaxial cable connector market has focused attention on improving electrical performance and minimization of overall costs, including materials costs, training requirements for installation personnel, reduction of dedicated installation tooling and the total number of required installation steps and/or operations.

Therefore, it is an object of the invention to provide a connector that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

Commonly owned U.S. patent application Ser. No. 12/264,932 "Insertion Coupling Coaxial Connector" by Jeffrey Paynter, filed Nov. 5, 2008 and hereby incorporated by reference in the entirety discloses several coaxial connector configurations featuring a grip rather than clamp mechanical interconnection between the connector and the outer conductor of the coaxial cable.

Figure 1:
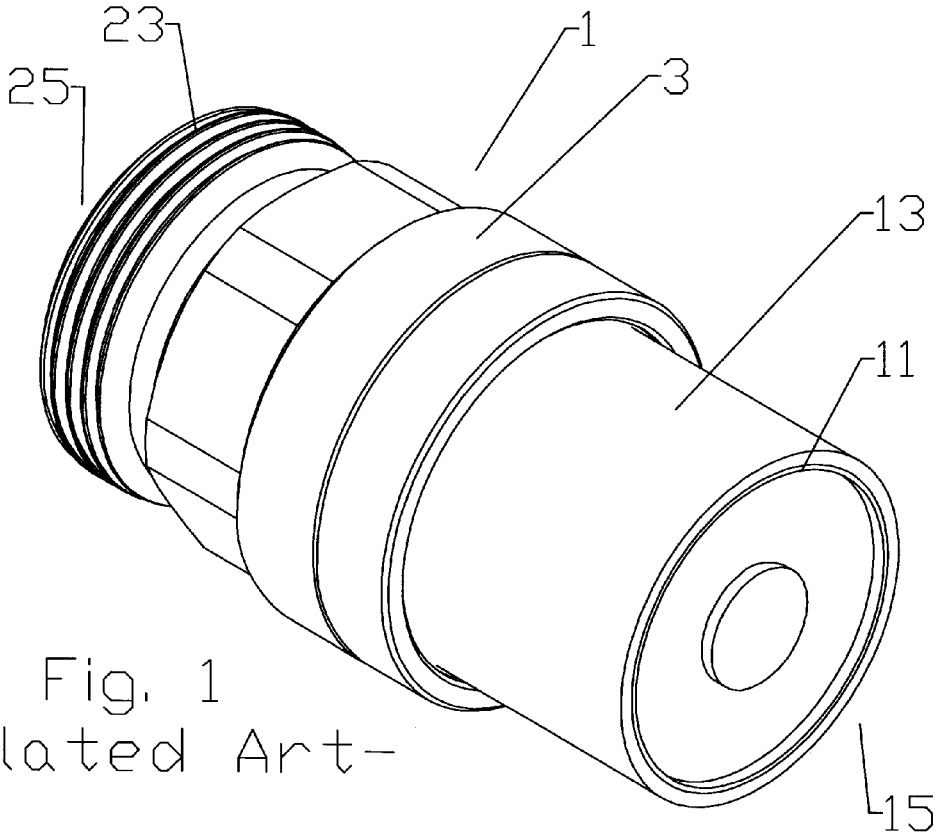
FIG. 1 is a schematic isometric rear view of an exemplary embodiment of a coaxial connector according to U.S. patent application Ser. No. 12/264,932.
Figure 2:
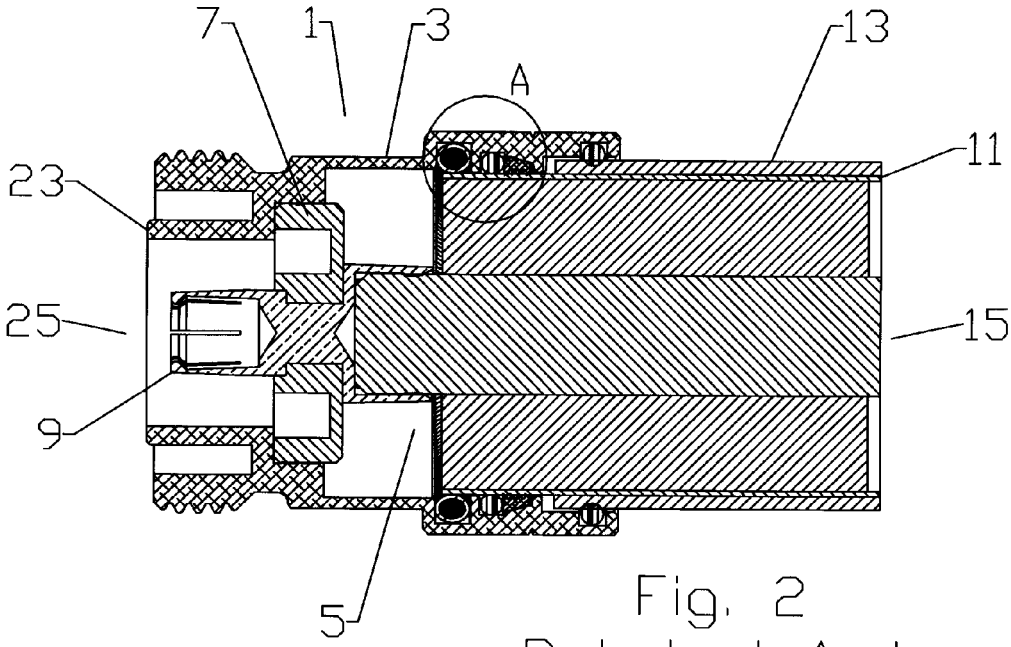
FIG. 2 is a schematic cross-section side view of the coaxial connector of FIG. 1, with a section of coaxial cable attached.
Figure 3:
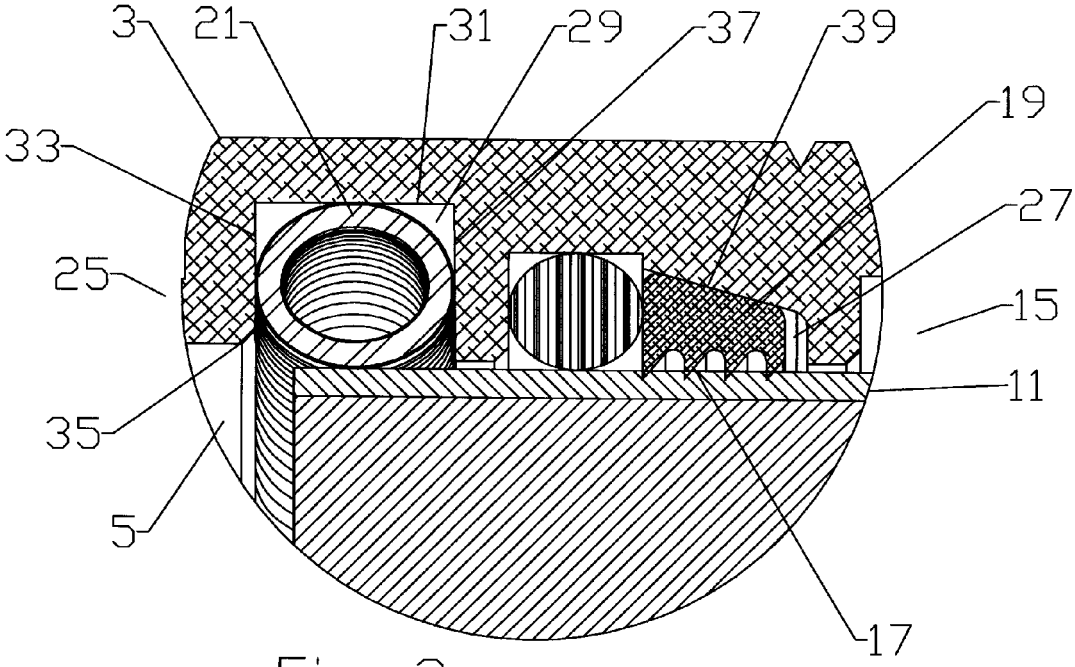
FIG. 3 is a close-up view of area A of FIG. 2.

As shown in FIGS. 1-3, a coaxial connecter 1 according to 12/264,932 has a connector body 3 with a connector body bore 5. An insulator 7 seated within the connector body bore 5 supports an inner contact 9 coaxial with the connector body bore 5. The coaxial connector 1 mechanically retains the outer conductor 11 of a coaxial cable 13 inserted into the cable end 15 of the connector body bore 5 via a grip surface 17 located on the inner diameter of a grip ring 19, for example seated within a grip ring groove 27. A circular spring contact 21, such as a helical coil spring ring, seated within the connector body bore 5 makes circumferential contact with the outer conductor 11, electrically coupling the outer conductor 11 across the connector body 3 to a connector interface 23 at the connector end 25. The connector interface 23 may be any desired standard or proprietary interface.

One skilled in the art will appreciate that the cable end 15 and the connector end 25 are descriptors used herein to clarify longitudinal locations and contacting interrelationships between the various elements of the coaxial connector 1. In addition to the identified positions in relation to adjacent elements along the coaxial connector 1 longitudinal axis, each individual element has a cable end 15 side and a connector end 25 side, i.e. the sides of the respective element that are facing the respective cable end 15 and the connector end 25 of the coaxial connector 1.

Electrical coupling between the outer conductor 11 and the connector body 3 is provided by the spring contact 21 seated proximate a leading edge of the outer conductor 11. The seating area for the circular spring contact 21, typically a rectangular contact groove 29 formed in the bore 5 sidewall, is generally dimensioned shallow enough to force the spring contact 21 into secure contact with the groove bottom 31 upon insertion of the leading edge of the outer conductor 11 into the connector body bore 5. A width of the contact groove 29 is typically dimensioned to receive the expected variance of spring contact 21 widths and to provide space for lateral deformation as the spring contact 21 is compressed/deformed between the groove bottom 31 and the outer conductor 11 during assembly.

Primary mechanical retention of the connector 1 to the outer conductor 11 is separately provided, for example in the 12/264,932 embodiment by a directional grip ring 19 gripping the outer conductor 11 that prevents longitudinal removal of the coaxial cable 13 from the connector 1 once inserted, but that does not rigidly clamp the connector 1 to the outer conductor 11, thus enabling rotation there between.

The inventor has recognized that, although a connector according to 12/264,932 enables rotation between the connector 1 and coaxial cable 13, such configurations may generate unacceptable levels of PIM, for example as less than uniform circumferential contact occurs between the spring contact 21 and one or more of the various surfaces of the contact groove 29 during assembly and/or upon post-assembly rotation between the coaxial cable 13 and the connector 1. It is believed that the presence of these multiple non-circumferentially uniform electrical paths between the spring contact 21 and the connector body 3 are contributors to the generation of PIM.

In a coupling arrangement according to the invention, primary and/or exclusive electrical contact between the spring contact 21 and the contact groove 29 is configured to occur along the connector end sidewall 33 of the contact groove 29. Thereby, any deformation of the spring contact 21 during assembly and/or post-assembly rotation may not create less than a uniform circumferential electrical interconnection along the connector end sidewall 33 of the contact groove 29.

Further, by configuring the depth and/or width of the contact groove 29 with respect to the selected spring contact 21 dimensions, the coupling arrangement may be configured such that no contact is made between the spring contact 29 and the groove bottom 31, even in the deformed state(s) of the spring contact 21 resulting from assembly and/or rotation after assembly.

To provide a seating surface for the spring contact 21, other than the groove bottom 31, the connector end sidewall 33 of the contact groove 29 may be angled or include transition features to transition between a groove bottom 31 width that is less than a groove top 35 width. The spring contact 21 has a non-deformed state width greater than the groove bottom 31 width and less than the groove top 35 width. At least while in a non-deformed state the spring contact 21 seats within the contact groove 29 contacting the connector end sidewall 33, without contacting the groove bottom 31.

Figure 4:
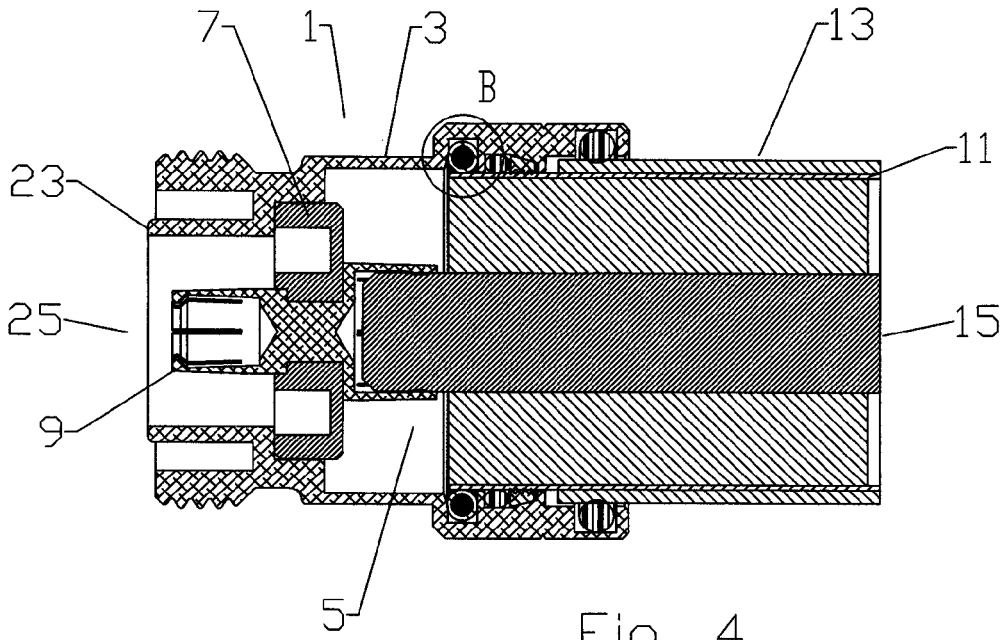
FIG. 4 is a schematic cross-section side view of a coaxial connector according to embodiments of the present invention, with a section of coaxial cable attached.
Figure 5:
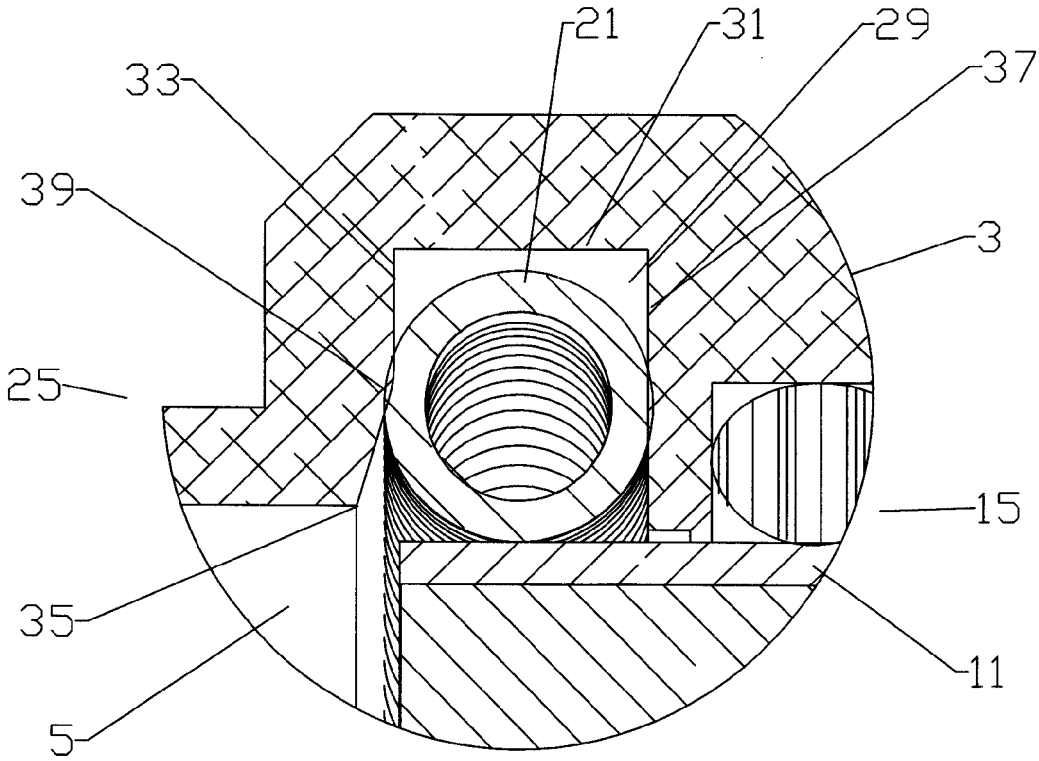
FIG. 5 is a close-up view of area B of FIG. 4.
Figure 6:
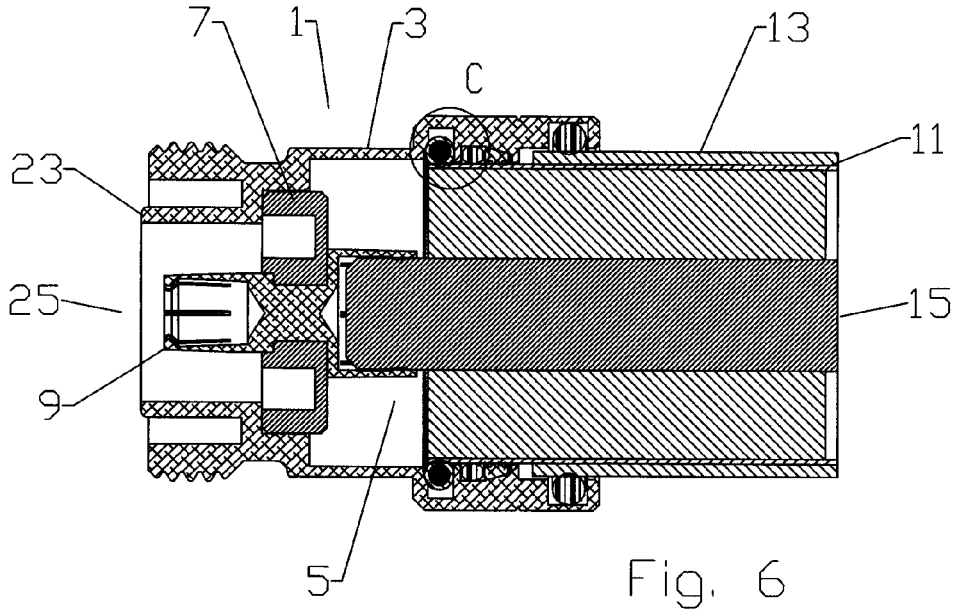
FIG. 6 is a schematic cross-section view of a second alternative embodiment coaxial connector, with a section of coaxial cable attached.
Figure 7:
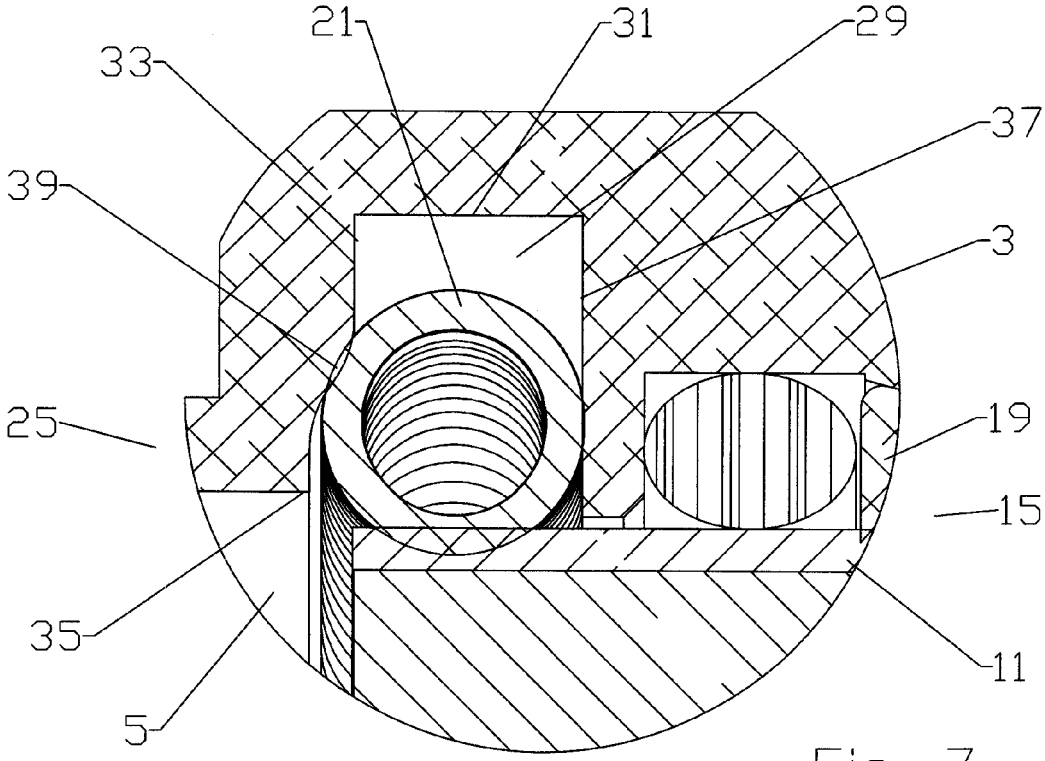
FIG. 7 is a close-up view of area C of FIG. 6.

The connector end sidewall 33 may be planar between the groove bottom 31 and the groove top 35 (see FIG. 9), or alternatively include a shoulder transition 39 against which the spring contact 21 seats. The shoulder transition 39 may be formed with a single corner, for example as demonstrated in FIGS. 4 and 5, or alternatively with multiple corners and/or curves as demonstrated in FIGS. 6 and 7.

Figure 8:
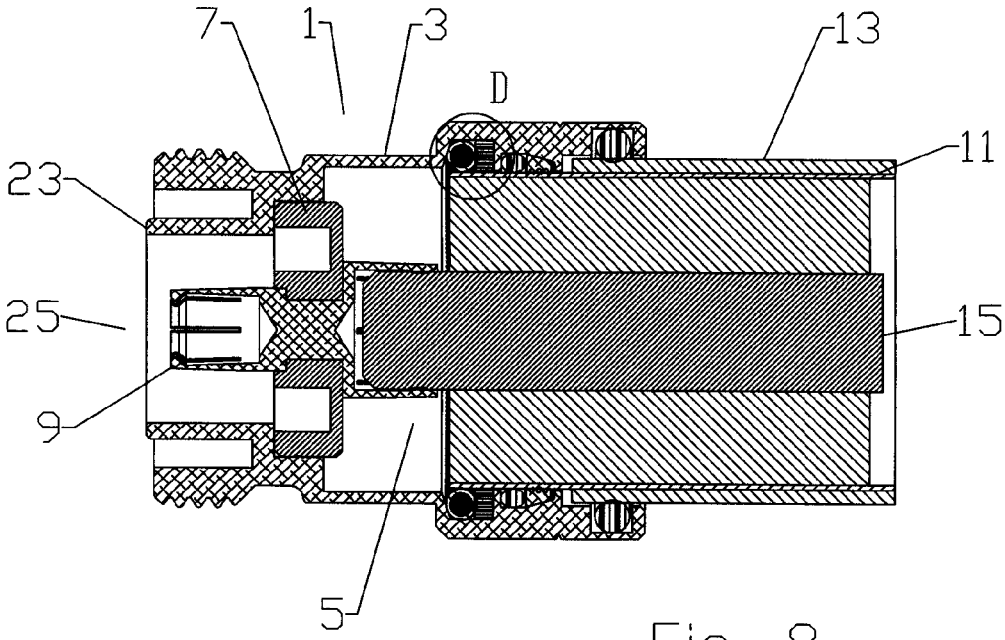
FIG. 8 is a schematic cross-section view of a third alternative embodiment coaxial connector, with a section of coaxial cable attached.
Figure 9:
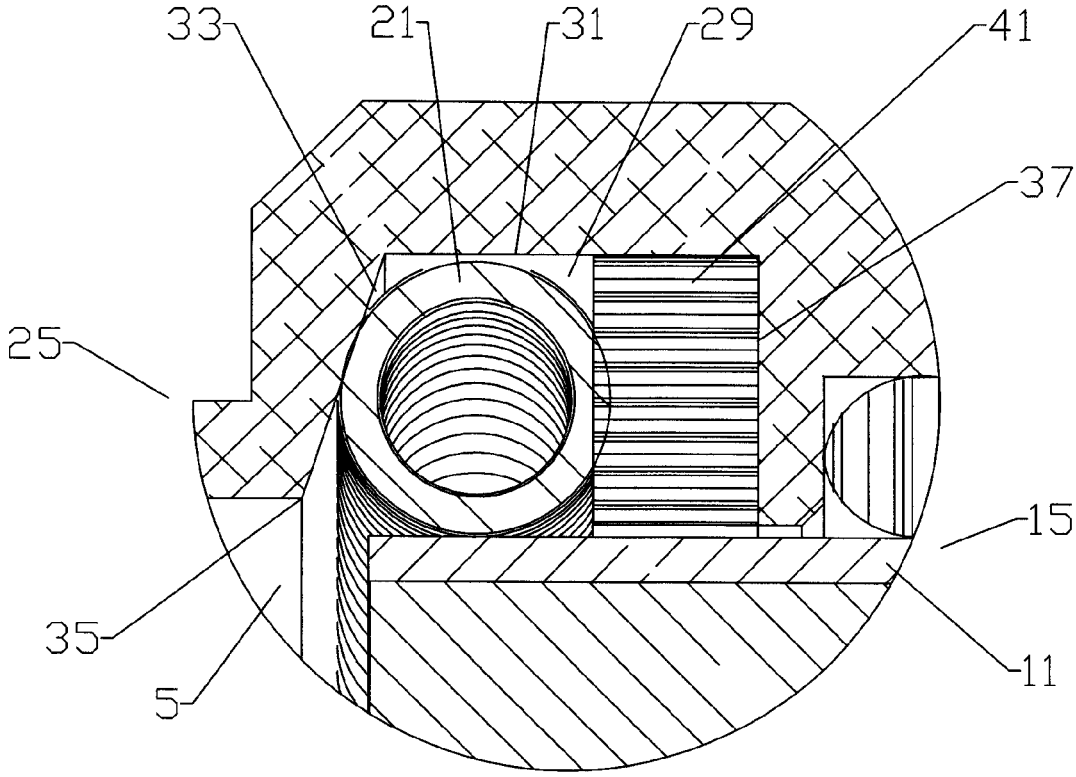
FIG. 9 is a close-up view of area D of FIG. 8.
Figure 10:
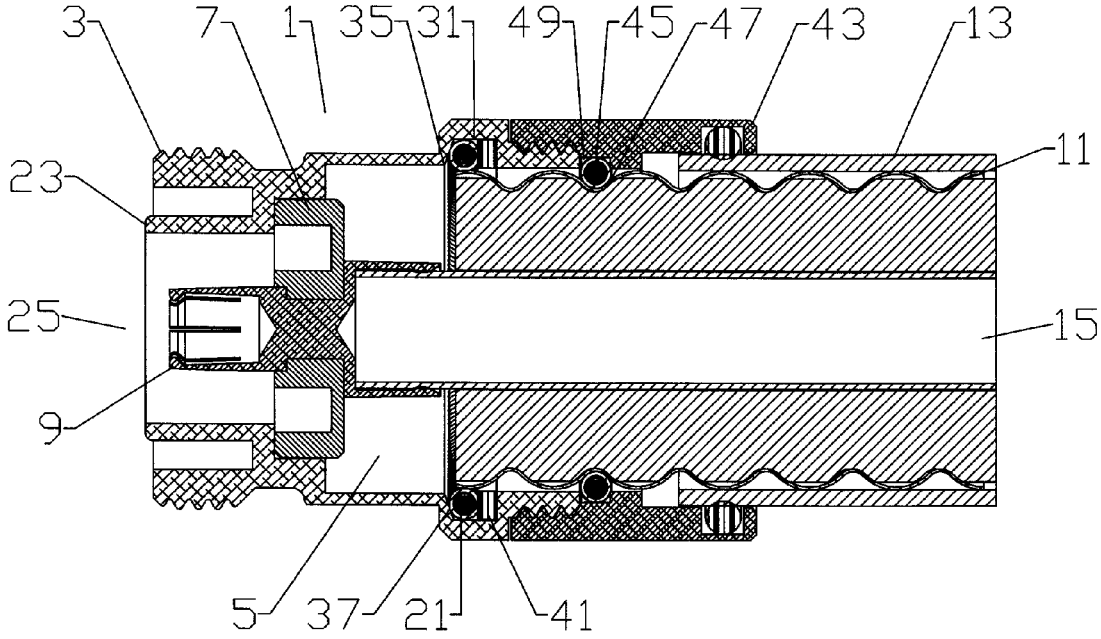
FIG. 10 is a schematic cross-section view of a second alternative embodiment coaxial connector, with a section of coaxial cable attached.

In further embodiments, a bias gasket 41 may be provided in the contact groove 29, between the spring contact 21 and the cable end sidewall 37, for example as demonstrated in FIGS. 8-10. The bias gasket 41 may be selected with elasticity characteristics and/or dimensioned to bias the spring contact 21 against the connector end sidewall 33, while the spring contact 21 is in the non-deformed state. In this configuration, once seated between the bias gasket 41 and the cable end sidewall 37, the bias gasket 41 provides an elastic gripping characteristic operative to engage and retain the spring contact 21 to inhibit further deformation of the spring contact 21 during rotation of the coaxial cable 13 with respect to the connector 1.

The coupling arrangement according to the invention does not require a grip ring 19 type mechanical interconnection. One skilled in the art will appreciate that other types of mechanical interconnection that also enable rotation of the interconnection may be applied. For example, as demonstrated in FIG. 10, where the connector 1 is configured for use with coaxial cable 13 having an annular corrugated outer conductor 11, the mechanical interconnection may be formed by providing a back nut 43 threadable onto the cable end 15 of the connector body 3 dimensioned to hold a retaining element proximate the cable end 15 of the connector body 3. The retaining element may be, for example, a plurality of arc inserts, a c-shaped ring, a retaining coil spring 45 or the like dimensioned to seat within a trough 47 of an annular corrugation of the outer conductor 11. When coupled together, the connector body 3 and back nut 43 together form an annular retaining groove 49. The retaining element is seated within the retaining groove 49, held captive in the selected trough 47 of the outer conductor 11, thereby longitudinally mechanically retaining the coaxial cable 13 within the connector body 3 but otherwise enabling rotation between the coaxial cable 13 and the connector 1.

By ensuring a uniform circumferential primary contact surface along the shortest electrical path to the connection interface 23, a coupling arrangement according to the invention enables improved PIM characteristics for connectors with a rotatable interconnection characteristic.

Table of Parts

| | |
|---|---|
| 1 | coaxial connector |
| 3 | connector body |
| 5 | connector body bore |
| 7 | insulator |
| 9 | inner contact |
| 11 | outer conductor |
| 13 | coaxial cable |
| 15 | cable end |
| 17 | grip surface |
| 19 | grip ring |
| 21 | spring contact |
| 23 | connector interface |
| 25 | connector end |
| 27 | grip ring groove |
| 29 | contact groove |
| 31 | groove bottom |
| 33 | connector end sidewall |
| 35 | groove top |
| 37 | cable end sidewall |
| 39 | shoulder transition |
| 41 | bias gasket |
| 43 | back nut |
| 45 | retaining coil spring |
| 47 | trough |
| 49 | retaining groove |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. A coupling arrangement between a coaxial connector and an outer conductor of a coaxial cable, comprising:

a unitary monolithic connector body;

an annular contact groove provided in a bore of the connector body, between a connector end and a cable end of the connector body;

the contact groove having a groove bottom, a connector end sidewall and a cable end sidewall; the connector end sidewall angled to transition between a groove bottom width that is less than a groove top width;

a circular spring contact having a non-deformed state width; the spring contact seated within the contact groove; the non-deformed state width greater than the groove bottom width and less than the groove top width; wherein in a non-deformed state the spring contact contacts the connector end sidewall without contacting the groove bottom.

2. The coupling arrangement of claim 1, further including an annular bias gasket in the contact groove between the spring contact and the cable end sidewall.

3. The coupling arrangement of claim 2, wherein the bias gasket is dimensioned to bias the spring contact against the connector end sidewall while the spring contact is in the non-deformed state.

4. The coupling arrangement of claim 1, further including a grip ring retained within a grip ring groove provided in the bore; an inner diameter of the grip ring provided with a grip surface; whereby the grip ring grips the outer conductor after the outer conductor is inserted through the grip ring.

5. The coupling arrangement of claim 1, further including a back nut threadable onto a cable end of the connector body and a retaining element proximate the cable end of the connector body.

6. The coupling arrangement of claim 5, wherein the retaining element is a retaining coil spring dimensioned to seat within an annular corrugation of the outer conductor.

7. The coupling arrangement of claim 5, wherein the connector body and the back nut together form an annular retaining groove; the retaining element seated within the retaining groove.

8. The coupling arrangement of claim 1, wherein the contact groove is located longitudinally on the connector body to position the spring contact proximate a leading edge of the outer conductor when the outer conductor is inserted within the connector bore.

9. The coupling arrangement of claim 1, wherein the spring contact is a helical coil spring.

10. A coupling arrangement between a coaxial connector body and an outer conductor of a coaxial cable, comprising:

an annular contact groove provided in a bore of the connector body;

the contact groove having a groove bottom, a connector end sidewall and a cable end sidewall; the connector end sidewall is angled at a shoulder transition to transition between a groove bottom width that is less than a groove top width; the spring contact contacting the shoulder transition;

a circular spring contact having a non-deformed state width; the spring contact seated within the contact groove; the non-deformed state width greater than the groove bottom width and less than the groove top width; wherein in a non-deformed state the spring contact contacts the connector end sidewall without contacting the groove bottom.

11. A coupling arrangement between a coaxial connector body and a solid outer conductor, comprising:

a contact groove provided in seamless monolithic portion of a bore of the connector body, between a connector end and a cable end of the connector body; the contact groove having a groove bottom, a connector end sidewall and a cable end sidewall; the connector end sidewall angled to transition between a groove bottom width that is less than a groove top width;

a circular spring contact having a non-deformed state width; the non-deformed state width greater than the groove floor width and less than the groove top width; the spring contact seated within the contact groove;

a bias gasket in the annular groove, between the spring contact and the cable end sidewall; the bias gasket dimensioned to bias the spring contact against the connector end sidewall, while in the spring contact is in the non-deformed state;

a grip ring retained within a grip ring groove provided in the bore; an inner diameter of the grip ring provided with a grip surface; whereby the grip ring grips the outer conductor after the outer conductor is inserted through the grip ring.

12. The coupling arrangement of claim 11, wherein the contact groove is located longitudinally on the connector body to position the spring contact proximate a leading edge of the outer conductor when the outer conductor is inserted within the connector bore.

13. The coupling arrangement of claim 11, wherein the spring contact is a helical coil spring.

14. A coupling arrangement between a coaxial connector body and a solid outer conductor, comprising:

a contact groove provided in a bore of the connector body; the contact groove having a groove bottom, a connector end sidewall and a cable end sidewall; the connector end sidewall is angled at a shoulder transition to transition between a groove bottom width that is less than a groove top width; the spring contact contacting the shoulder transition;

a circular spring contact having a non-deformed state width; the non-deformed state width greater than the groove floor width and less than the groove top width; the spring contact seated within the contact groove;

a bias gasket in the annular groove, between the spring contact and the cable end sidewall; the bias gasket dimensioned to bias the spring contact against the connector end sidewall, while in the spring contact is in the non-deformed state;

a grip ring retained within a grip ring groove provided in the bore; an inner diameter of the grip ring provided with a grip surface; whereby the grip ring grips the outer conductor after the outer conductor is inserted through the grip ring.

15. A coupling arrangement between a coaxial connector body and a solid outer conductor, comprising:

a contact groove provided in a bore of the connector body; the contact groove having a groove bottom, a connector end sidewall and a cable end sidewall; the connector end sidewall angled to transition between a groove bottom width that is less than a groove top width;

a spring contact having a non-deformed state width; the non-deformed state width greater than the groove bottom width and less than the groove top width; the circular spring contact seated within the annular groove;

a back nut threadable onto the cable end of the connector body;

a retaining coil spring dimensioned to seat within an annular corrugation of the outer conductor; the connector body and the back nut together forming an annular retaining groove; the retaining circular coil spring seated within the retaining groove.

16. The coupling arrangement of claim 15, further including a bias gasket in the contact groove between the spring contact and the cable end sidewall; the bias gasket dimensioned to bias the spring contact against the connector end sidewall while in the spring contact is in the non-deformed state.

17. The coupling arrangement of claim 16, wherein the bias gasket is dimensioned to bias the spring contact against the connector end sidewall, while the spring contact is in the non-deformed state.

18. The coupling arrangement of claim 15, wherein the connector end sidewall is angled at a shoulder transition; the spring contact contacting the shoulder transition.

19. The coupling arrangement of claim 15, wherein the contact groove is located longitudinally on the connector body to position the spring contact proximate a leading edge of the outer conductor when the outer conductor is inserted within the connector bore.

20. The coupling arrangement of claim 15, wherein the spring contact is a helical coil spring.

* * * * *